US010286677B2

(12) United States Patent
Yokozawa et al.

(10) Patent No.: US 10,286,677 B2
(45) Date of Patent: May 14, 2019

(54) LIQUID SUPPLY DEVICE AND LIQUID EJECTING APPARATUS

(71) Applicant: SEIKO EPSON CORPORATION, Tokyo (JP)

(72) Inventors: Toshihiro Yokozawa, Milan (IT); Jun Shimazaki, Shiojiri (JP); Junpei Yamashita, Azumino (JP); Katsumi Shinkai, Fujimi (JP); Masahiro Nakamura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/642,809

(22) Filed: Jul. 6, 2017

(65) Prior Publication Data

US 2018/0009231 A1 Jan. 11, 2018

(30) Foreign Application Priority Data

Jul. 11, 2016 (JP) ..... 2016-136692
Jul. 14, 2016 (JP) ..... 2016-139147

(51) Int. Cl.
*B41J 2/175* (2006.01)

(52) U.S. Cl.
CPC ..... *B41J 2/17596* (2013.01); *B41J 2/17563* (2013.01)

(58) Field of Classification Search
CPC .... B41J 2/17553; B41J 2/175; B41J 2/17509; B41J 2/17523; B41J 2/17506; B41J 29/02; B41J 2/17503; B41J 2/17596; B41J 2/17563
USPC ..... 347/6, 7, 84–86
See application file for complete search history.

(56) References Cited

U.S. PATENT DOCUMENTS

| | | | |
|---|---|---|---|
| 2002/0024543 | A1 | 2/2002 | Kimura et al. |
| 2010/0079513 | A1 | 4/2010 | Taira et al. |
| 2013/0286116 | A1 | 10/2013 | Tsukahara et al. |
| 2014/0253645 | A1 | 9/2014 | Tsukahara et al. |

FOREIGN PATENT DOCUMENTS

| | | | |
|---|---|---|---|
| JP | 05-116337 | A | 5/1993 |
| JP | 10-193639 | A | 7/1998 |
| JP | 11-320913 | A | 11/1999 |
| JP | 2000-015836 | A | 1/2000 |
| JP | 2000-158663 | A | 6/2000 |
| JP | 2000-238295 | A | 9/2000 |
| JP | 3575376 | B | 8/2001 |
| JP | 2004-025727 | A | 1/2004 |
| JP | 2004-122704 | A | 4/2004 |

(Continued)

*Primary Examiner* — Jannelle M Lebron
(74) *Attorney, Agent, or Firm* — Workman Nydegger

(57) ABSTRACT

A liquid supply device includes a connection body which includes a liquid introduction portion which is capable of connecting to a liquid outlet portion of a liquid container which includes the liquid outlet portion which contains the liquid which is supplied to the liquid ejecting unit which ejects the liquid and is capable of guiding out the liquid, a liquid container support portion which is capable of supporting the liquid container in a state in which the liquid introduction portion is capable of being connected to the liquid outlet portion to be capable of being freely attached and detached, and a connection body holding portion which holds the connection body in a state in which a connection of the liquid introduction portion with the liquid outlet portion is released.

8 Claims, 8 Drawing Sheets

(56) References Cited

FOREIGN PATENT DOCUMENTS

| | | | |
|---|---|---|---|
| JP | 2005-053075 | A | 3/2005 |
| JP | 2005-119179 | A | 5/2005 |
| JP | 2005-138498 | A | 6/2005 |
| JP | 2006-021398 | A | 1/2006 |
| JP | 2007-290388 | A | 11/2007 |
| JP | 2009-241385 | A | 10/2009 |
| JP | 2010-069807 | A | 4/2010 |
| JP | 2010-076301 | A | 4/2010 |
| JP | 2010-228147 | A | 10/2010 |
| JP | 2011-167873 | A | 9/2011 |
| JP | 2011-201234 | A | 10/2011 |
| JP | 2012-183730 | A | 9/2012 |
| JP | 2014-024320 | A | 2/2014 |
| JP | 2015-058672 | A | 3/2015 |
| JP | 2015-107660 | A | 6/2015 |
| JP | 2015-112800 | A | 6/2015 |
| JP | 2016-068314 | A | 5/2016 |

LIQUID SUPPLY DEVICE AND LIQUID EJECTING APPARATUS

BACKGROUND

1. Technical Field

The present invention relates to a liquid ejecting apparatus such as an ink jet printer, for example, and a liquid supply device which is provided in a liquid ejecting apparatus.

2. Related Art

Generally, an ink jet printer is widely known as a type of liquid ejecting apparatus. Such a printer is provided with a carriage and a recording head which is supported on the carriage, and performs printing by ejecting an ink which is supplied from an ink supply apparatus onto a sheet from the recording head while causing the carriage to move reciprocally along a scanning direction (for example, refer to JP-A-2015-107660).

An ink supply apparatus is provided with an ink container which includes an ink bag which is filled with an ink and an ink outlet portion which communicates with the inside of the ink bag, a case which houses the ink container, a left recessed portion and a right recessed portion which are provided in the case and support the ink container, an ink introduction needle which can be connected to the ink outlet portion, and a connection tube which connects the ink introduction needle to the printer. The ink container is set inside the case so as to be supported in an attachable and detachable manner by the left recessed portion and the right recessed portion such that the ink outlet portion is positioned closer to the top side in the gravity direction than the ink bag.

There is an apparatus which supplies an ink of an ink tank to a recording head via an ink supply path through the driving of a pump (for example, refer to JP-A-2014-24320).

In an ink supply apparatus such as that described above in JP-A-2015-107660, an ink introduction needle which is in a state of not being connected to an ink outlet portion is not held and is in a free state at a specific position. Therefore, since the ink introduction needle which is in a free state becomes a nuisance when setting the an ink container in a case, there is a problem in that the work of setting the ink container in the case becomes troublesome.

In a printer such as the one described above in JP-A-2014-24320, in a case in which a filter which filters an ink is disposed in a position part way down an ink supply path, for example, since bubbles inside the ink supply path are easily retained on the surface of the upstream side (an ink tank side) in the filter, there is a problem in that it is difficult to efficiently discharge the retained bubbles.

This problem is not limited to an ink jet printer which ejects an ink from a nozzle to perform printing, and is generally common to liquid ejecting apparatuses in which a filter is disposed in a liquid supply path which supplies a liquid to a liquid ejecting unit which ejects the liquid.

SUMMARY

An advantage of some aspects of the invention is to provide a liquid supply device and a liquid ejecting apparatus in which it is possible to easily set a liquid container in a liquid container support portion.

Another advantage of some aspects of the invention is to provide a liquid ejecting apparatus which is capable of efficiently discharging bubbles which are inside a liquid supply path in which a filter is disposed.

Hereinafter, means of the invention and operation effects thereof will be described.

According to an aspect of the invention, a liquid supply device which supplies a liquid to a liquid ejecting unit which ejects the liquid includes a connection body which includes a liquid introduction portion which is capable of connecting to a liquid outlet portion of a liquid container which includes the liquid outlet portion which contains the liquid which is supplied to the liquid ejecting unit and is capable of guiding out the liquid, a liquid container support portion which is capable of supporting the liquid container in a state in which the liquid introduction portion is capable of being connected to the liquid outlet portion to be capable of being freely attached and detached, and a connection body holding portion which holds the connection body in a state in which a connection of the liquid introduction portion with the liquid outlet portion is released.

According to this configuration, since the connection body which is in a state in which the connection of the liquid introduction portion with the liquid outlet portion is released is held in a determined position by the connection body holding portion, it is possible to easily set the liquid container in the liquid container support portion.

In the liquid supply device, it is preferable that in the connection body holding portion, the connection body which is held by the connection body holding portion and the connection body holding portion be provided to deviate from a setting path which is passed through when the liquid container is set in the liquid container support portion.

According to this configuration, since the connection body and the connection body holding portion do not interfere when setting the liquid container in the liquid container support portion, it is possible to easily set the liquid container in the liquid container support portion.

In the liquid supply device, it is preferable that the liquid container support portion include a mounting surface onto which the liquid container is mounted, and in the connection body holding portion, the connection body which is held by the connection body holding portion and the connection body holding portion be provided to be positioned below a plane which includes the mounting surface.

According to this configuration, since the connection body and the connection body holding portion do not interfere when mounting the liquid container on the mounting surface, it is possible to easily set the liquid container in the liquid container support portion.

In the liquid supply device, it is preferable that the mounting surface be inclined such that a back side in a setting direction is lower than a front side in the setting direction with respect to the liquid container support portion of the liquid container.

According to this configuration, it is possible to easily move the liquid container to the setting position while sliding on the mounting surface by using the weight of the liquid container.

In the liquid supply device, it is preferable that the connection body holding portion be provided closer to a front side in a setting direction with respect to the liquid container support portion of the liquid container than the liquid container which is supported by the liquid container support portion.

According to this configuration, it is possible to easily connect the liquid introduction portion of the connection body to the liquid outlet portion of the liquid container after setting the liquid container in the liquid container support portion.

In the liquid supply device, it is preferable that the connection body include a locking-target portion which is locked to a locking portion of the liquid container in a state in which the liquid introduction portion is connected to the liquid outlet portion, and an operation unit which releases a locking state between the locking-target portion and the locking portion, and the connection body holding portion may hold the connection body in a posture at which the operation units are closer to a front side in a setting direction with respect to the liquid container support portion of the liquid container than the locking-target portion.

According to this configuration, it is possible to easily remove the connection body from the connection body holding portion when connecting the connection body (the liquid introduction portion) to the liquid outlet portion of the liquid container, and it is possible to easily cause the connection body holding portion to hold the connection body which is removed from the liquid outlet portion.

In the liquid supply device, it is preferable that the connection body include an electrical connection portion to which the liquid container is connected, and the connection body holding portion hold the connection body in a posture at which the electrical connection portion is closer to a top side than the liquid introduction portion.

According to this configuration, in a case in which the liquid leaks out from the liquid introduction portion or a similar event occurs, it is possible to suppress the adherence of the liquid which leaks out to the electrical connection portion.

In the liquid supply device, it is preferable that the connection body holding portion include a cap portion which covers the liquid introduction portion or a space which includes the liquid introduction portion.

According to this configuration, it is possible to suppress the evaporation of the solvent component of the liquid from the liquid introduction portion which is not connected to the liquid outlet portion which leads to the viscosity of the liquid being increased, and foreign matter such as dust adhering to the liquid introduction portion, and the like.

According to another aspect of the invention, a liquid ejecting apparatus includes a liquid ejecting unit which ejects a liquid, and a liquid supply device which supplies the liquid to the liquid ejecting unit, in which the liquid supply device includes a connection body which includes a liquid introduction portion which is capable of connecting to a liquid outlet portion of a liquid container which includes the liquid outlet portion which contains the liquid which is supplied to the liquid ejecting unit and is capable of guiding out the liquid, a liquid container support portion which is capable of supporting the liquid container in a state in which the liquid introduction portion is capable of being connected to the liquid outlet portion to be capable of being freely attached and detached, and a connection body holding portion which holds the connection body in a state in which a connection of the liquid introduction portion with the liquid outlet portion is released.

According to this configuration, it is possible to obtain the same operations and effects as achieved by the liquid supply device which is described above.

According to still another aspect of the invention, a liquid ejecting apparatus includes a liquid ejecting unit which ejects a liquid which is supplied from a liquid supply source via a liquid supply path, a filter portion which includes a filter which is disposed in the liquid supply path and collects foreign matter, and an upstream side filter chamber which stores the liquid which passes through the filter, and a discharge flow path which is connected to the upstream side filter chamber and is capable of discharging a liquid inside the liquid supply path to an outside.

According to this configuration, since it is possible to discharge the bubbles which are retained in the upstream side filter chamber from the discharge flow path directly to the outside, it is possible to efficiently discharge the bubbles which are inside the liquid supply path in which the filter is disposed.

In the liquid ejecting apparatus, it is preferable that a supply pump which supplies the liquid to the liquid ejecting unit side be provided in a position which is closer to the liquid supply source side than the filter portion in the liquid supply path.

According to this configuration, it is possible to supply the liquid from the liquid supply source to the liquid ejecting unit by driving the supply pump.

It is preferable that the liquid ejecting apparatus further include a control unit which controls the supply pump, in which the control unit drive the supply pump in a state in which the discharge flow path is communicated with the outside.

According to this configuration, it is possible to discharge the liquid (the fluid) which includes the bubbles inside the liquid supply path from the discharge flow path to the outside by driving the supply pump using the control unit.

It is preferable that the liquid ejecting apparatus further include a discharge valve which is capable of being switched between a communicating state in which the discharge flow path is communicated with the outside, and a non-communicating state in which the discharge flow path is not communicated with the outside.

According to this configuration, by using the opening and closing operations of the discharge valve, the discharge valve is capable of being switched between the communicating state in which the discharge flow path is communicated with the outside, and the non-communicating state in which the discharge flow path is not communicated with the outside.

It is preferable that the liquid ejecting apparatus further include a control unit which controls the discharge valve, in which the control unit control the discharge valve to switch from the non-communicating state to the communicating state in a state in which an inside of the liquid supply path is pressurized.

According to this configuration, by switching to the communicating state in which the discharge flow path is communicated with the outside by controlling the discharge valve using the control unit, it is possible to discharge the liquid (the fluid) which includes the bubbles inside the liquid supply path from the discharge flow path to the outside.

It is preferable that the liquid ejecting apparatus further include a pressure sensor which detects a pressure inside the liquid supply path.

According to this configuration, it is possible to detect the pressure inside the liquid supply path by using the pressure sensor.

It is preferable that the liquid ejecting apparatus further include a supply pump which is provided in a position which is closer to the liquid supply source side than the filter portion in the liquid supply path and supplies the liquid to the liquid ejecting unit side, a discharge valve which is capable of being switched between a communicating state and a non-communicating state with respect to the outside of the discharge flow path, a pressure sensor which detects a pressure inside the liquid supply path, a control unit which controls the discharge valve and the supply pump, and an estimation unit which estimates a degree of clogging of the filter based on the pressure which is detected by the pressure sensor in a state in which the supply pump is driven when the discharge flow path is in the non-communicating state with respect to the outside.

According to this configuration, since it is possible to estimate the degree of clogging of the filter using the pressure sensor by using the estimation unit, it is possible to perform supply control of the liquid and the estimation of the exchanging time of the filter according to the degree of clogging of the filter.

In the liquid ejecting apparatus, it is preferable that the control unit control the discharge valve such that the discharge flow path switches from the non-communicating state to the communicating state with respect to the outside in a state in which an inside of the liquid supply path is pressurized before a filter clogging estimation operation which is executed when estimating the degree of clogging of the filter by using the estimation unit.

According to this configuration, since the filter clogging estimation operation is executed after the bubbles of the upstream side filter chamber are discharged from the discharge flow path, it is possible to suppress erroneous estimation in the filter clogging estimation operation by the estimation unit which is caused by the bubbles. Therefore, it is possible to estimate the degree of clogging of the filter with a higher accuracy.

In the liquid ejecting apparatus, it is preferable that in a case in which a pressure which is detected by the pressure sensor is higher than a threshold which is set, the estimation unit estimate that the degree of clogging of the filter is a state in which it is necessary to exchange the filter.

According to this configuration, it is possible to estimate the exchanging time of the filter.

In the liquid ejecting apparatus, it is preferable that the pressure sensor be provided in the discharge flow path.

According to this configuration, since it becomes difficult for the pressure sensor to detect minute pressure fluctuations in the liquid supply path caused by the driving of the supply pump in a case in which the supply pump which supplies the liquid from the liquid supply source toward the liquid ejecting unit is provided in the liquid supply path, for example, it is possible to accurately detect the pressure inside the liquid supply path.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, description will be given of an embodiment of a liquid ejecting apparatus according to the drawings.

Figure 1:
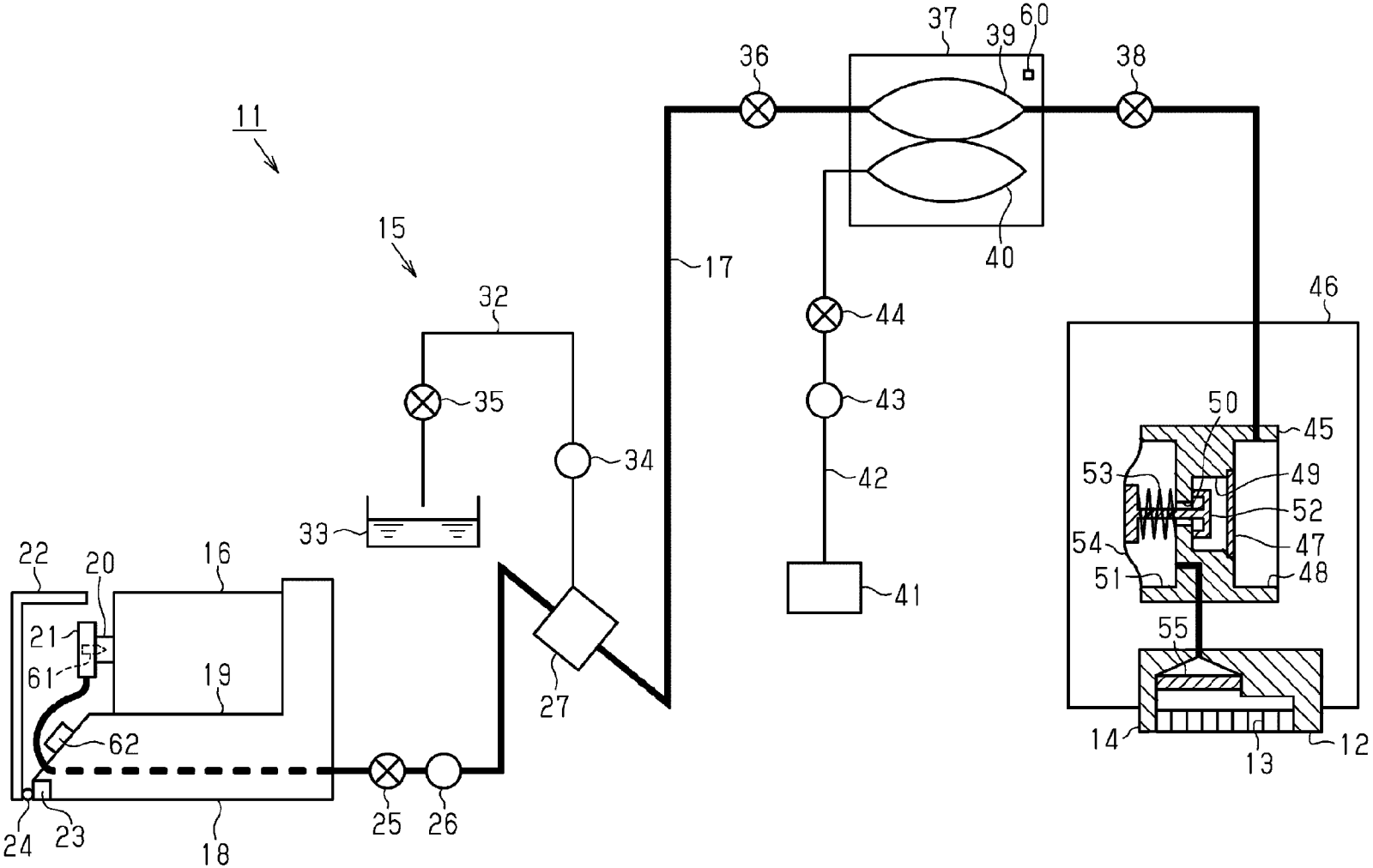
FIG. 1 is a schematic diagram illustrating the schematic configuration of an ink jet printer of an embodiment.

As illustrated in FIG. 1, an ink jet printer 11 which serves as an example of a liquid ejecting apparatus is provided with a liquid ejecting unit 14 and a liquid supply device 15. The liquid ejecting unit 14 ejects an ink which serves as an example of the liquid from a plurality of nozzles 13 which are formed in a nozzle forming surface 12, and the liquid supply device 15 supplies the ink to the liquid ejecting unit 14.

A left-right direction on the paper surface in FIG. 1 corresponds to a vertical direction (a gravity direction), and the bottom side in the vertical direction is the right side of the paper surface.

The liquid supply device 15 is provided with a tank holder 18 which serves as an example of a liquid container support portion which is capable of supporting a main tank 16 which serves as an example of a liquid container which includes a liquid outlet portion 20 which contains an ink to be supplied to the liquid ejecting unit 14 and is capable of guiding out the ink. The tank holder 18 includes a mounting surface 19 on which the main tank 16 is mounted, and the main tank 16 includes the liquid outlet portion 20 for guiding out the ink of the inner portion of the main tank 16.

The liquid supply device 15 is provided with a connection body 21 and a connection body holding portion 62. The connection body 21 includes a liquid introduction portion 61 which can be connected to the liquid outlet portion 20 of the main tank 16 to be capable of being freely attached and detached, and the connection body holding portion 62 holds the connection body 21 which is in a state in which the liquid introduction portion 61 is disconnected from the liquid outlet portion 20. The connection body holding portion 62 is provided on the tank holder 18. The tank holder 18 supports the main tank 16 with the mounting surface 19 in a state in which the liquid introduction portion 61 can be connected in a freely attachable and detachable manner to the liquid outlet portion 20.

The liquid supply device 15 is provided with a liquid supply path 17 which supplies the ink which is inside the main tank 16 to the liquid ejecting unit 14. The liquid supply path 17 is formed using a flexible tube or the like, for example. The upstream end side of the liquid supply path 17 is connected to the connection body 21, and the downstream end side of the liquid supply path 17 is connected to the liquid ejecting unit 14. Therefore, the ink which is inside the main tank 16 is supplied from the main tank 16 which is the upstream side, via the liquid outlet portion 20, the connection body 21 (the liquid introduction portion 61), and the liquid supply path 17, to the liquid ejecting unit 14 which is the downstream side.

The tank holder 18 is provided with a cover 22 which covers the liquid outlet portion 20 side of the main tank 16 which is supported by the tank holder 18, and a cover sensor 23 which detects the opening-closing state of the cover 22. The cover 22 is provided on the tank holder 18 to be rotate freely around a rotating shaft 24 between a closed position (the position illustrated in FIG. 1) and an opened position (the position illustrated in FIG. 4). In the closed position, the cover 22 covers the liquid outlet portion 20 side of the main tank 16 which is supported by the tank holder 18, and the opened position, the cover 22 opens the liquid outlet portion 20 side of the main tank 16 which is supported by the tank holder 18.

In the liquid supply path 17, a supply valve 25 for opening and closing the liquid supply path 17 is provided on the downstream side of the connection body 21 and the tank holder 18, and on the downstream side of the supply valve 25, a supply pump 26 which causes an ink in the liquid supply path 17 to flow toward the downstream side is provided. The supply valve 25 is configured using an electric valve, for example, and the supply pump 26 is configured using a diaphragm pump. The supply valve 25 is set to be in a closed state when the power supply of the ink jet printer 11 is off.

A filter portion 27 which collects foreign matter in the ink which flows in the liquid supply path 17 is provided on the downstream side of the supply pump 26 in the liquid supply path 17. Therefore, the supply pump 26 which supplies the ink to the liquid ejecting unit 14 side is disposed in a position which is closer to the main tank 16 side than the filter portion 27 in the liquid supply path 17.

Figure 2:
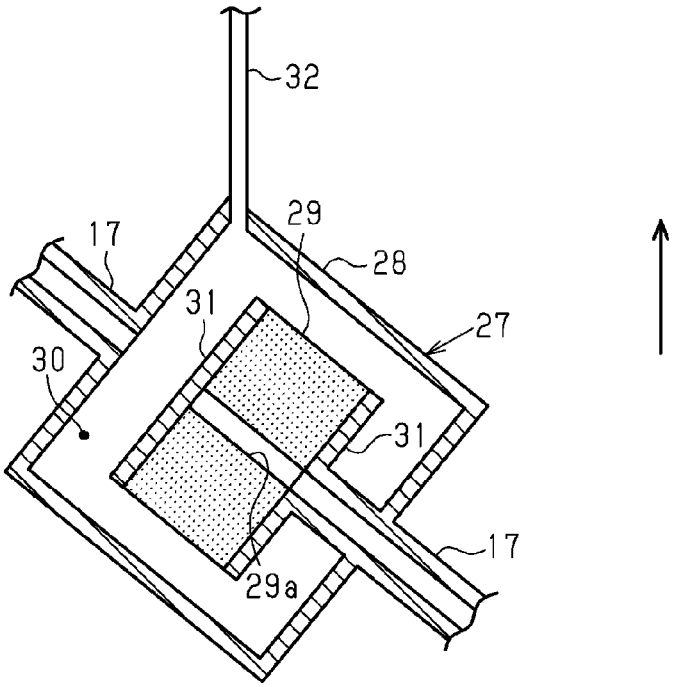
FIG. 2 is a schematic sectional diagram of a filter portion in the ink jet printer.

As illustrated in FIGS. 1 and 2, the filter portion 27 is provided with a case 28, a filter 29, and an upstream side filter chamber 30. The case 28 has a hollow cylindrical shape, the filter 29 is disposed in the center portion of the inside of the case 28 and has a tubular shape, and the upstream side filter chamber 30 is a space inside the case 28 and is positioned on the upstream side of the filter 29. The upstream side filter chamber 30 communicates with the liquid supply path 17 of the upstream side of the filter portion 27. The filter portion 27 is disposed to be inclined such that the upstream side becomes higher than the downstream side. Both sides of the filter 29 in the axial line direction are blocked by respective support plates 31, and a hole 29*a* in the center of the filter 29 communicates with the liquid supply path 17 of the downstream side of the filter portion 27.

Foreign matter including bubbles and the like is removed from the ink in a process in which the ink which is supplied to the filter portion 27 from the upstream side is temporarily stored in the upstream side filter chamber 30, and subsequently enters the filter 29 from the outer circumferential surface of the filter 29 to reach the hole 29*a*. The ink from which the foreign matter is removed due to the ink passing through the filter 29 is supplied from the hole 29*a* of the filter 29 to the liquid supply path 17 of the downstream side of the filter portion 27.

An upstream end of a discharge flow path 32 is connected to the top end portion in the upstream side filter chamber 30, that is, to the end portion (an end portion in the direction indicated using an arrow in FIG. 2) of the opposite side from the gravity direction in the upstream side filter chamber 30, and a downstream end of the discharge flow path 32 is inserted into a waste liquid tank 33. The discharge flow path 32 is capable of discharging a fluid such as an ink or bubbles inside the liquid supply path 17 to the outside. In this case, the upstream end of the discharge flow path 32 is connected to a corner portion which is the highest position in the upstream side filter chamber 30. In other words, the upstream end of the discharge flow path 32 is connected to the position at which bubbles are most likely to accumulate in the upstream side filter chamber 30.

A liquid pressure sensor 34 which detects the pressure inside the liquid supply path 17 is provided in a position part way down the discharge flow path 32. A discharge valve 35 which opens and closes the discharge flow path 32 is provided on the downstream side of the liquid pressure sensor 34 in the discharge flow path 32. In other words, by using the opening and closing operations, the discharge valve 35 is capable of being switched between a communicating state in which the discharge flow path 32 is communicated with the outside, and a non-communicating state in which the discharge flow path 32 is not communicated with the outside. The discharge valve 35 is configured using an electromagnetic valve, for example, and is set to be in an open-valve state when the power supply of the ink jet printer 11 is off.

As illustrated in FIG. 1, an upstream valve 36 which opens and closes the liquid supply path 17 is provided on the downstream side of the filter portion 27 in the liquid supply path 17. A sub-tank unit 37 which stores an ink which is supplied from the main tank 16 is provided on the downstream side of the upstream valve 36 in the liquid supply path 17. A downstream valve 38 which opens and closes the liquid supply path 17 is provided on the downstream side of the sub-tank unit 37 in the liquid supply path 17. The upstream valve 36 and the downstream valve 38 are configured using respective electromagnetic valves, and are set to respectively be in a closed-valve state when the power supply of the ink jet printer 11 is off.

The sub-tank unit 37 is provided with an intermediate storage portion 39, a liquid amount sensor 60, and a pushing portion 40. The intermediate storage portion 39 is formed of a flexible member and has a bag shape, and the pushing portion 40 is formed of a flexible member and has a bag shape. The intermediate storage portion 39 is disposed in a position part way down the liquid supply path 17, and expands and shrinks depending on the amount of the ink which is stored in the inner portion. The liquid amount sensor 60 detects the ink amount inside the intermediate storage portion 39 from the degree of expansion of the intermediate storage portion 39. The pushing portion 40 is disposed to be adjacent to the intermediate storage portion 39. A downstream side of an air supply path 42 which extends from an air supply unit 41 is connected to the pushing portion 40. An air supply unit which is provided in the facilities of a factory or the like may be used for the air supply unit 41, and the air supply unit 41 may be configured using an air pump or the like.

An air pressure sensor 43 which detects the air pressure inside the air supply path 42 is provided in a position part way down the air supply path 42, and an air valve 44 which opens and closes the air supply path 42 is provided in a position which is closer to the pushing portion 40 side than the air pressure sensor 43 in the air supply path 42. When the pushing portion 40 receives a supply of air from the air supply unit 41 and expends in a state in which the upstream valve 36 is opened and the downstream valve 38 is closed, the intermediate storage portion 39 is pushed by the pushing portion 40 and the ink which is stored inside the intermediate storage portion 39 is supplied to the liquid ejecting unit 14 side.

A pressure adjustment valve 45 which adjusts the pressure of the ink which is supplied to the liquid ejecting unit 14 is provided on the downstream side of the downstream valve 38 in the liquid supply path 17, and the liquid ejecting unit 14 to which the downstream end side of the liquid supply path 17 is connected is disposed on the downstream side of the pressure adjustment valve 45. The pressure adjustment valve 45 and the liquid ejecting unit 14 may be supported by a carriage 46 which is provided to be capable of moving reciprocally along the scanning direction. In this case, the liquid ejecting unit 14 is disposed on the bottom end portion of the carriage 46. The pressure adjustment valve 45 and the liquid ejecting unit 14 are formed integrally.

The pressure adjustment valve 45 is provided with a filter chamber 48 and a supply chamber 49 which are partitioned by an intra-valve filter 47 which captures foreign matter such as bubbled which are in the ink. The pressure adjustment valve 45 is provided with a pressure chamber 51, a valve body 52, and a biasing member 53. The pressure chamber 51 communicates with the pressure adjustment valve 45 via the supply chamber 49 and a communicating hole 50, the valve body 52 is provided between the pressure chamber 51 and the supply chamber 49, and the biasing member 53 biases the valve body 52 in a valve closing direction. In other words, the communicating hole 50 passes through the valve body 52, and is provided to block the communicating hole 50 by being biased by the biasing member 53.

The pressure chamber 51 is configured using a diaphragm 54 which is capable of flexural deformation along the biasing direction of the biasing member 53. The diaphragm 54 receives atmospheric pressure on the outer surface side (the left surface side in FIG. 1), whereas the diaphragm 54 receives the pressure of the ink which is inside the pressure chamber 51 on the inner surface side (the right surface side in FIG. 1). Therefore, the diaphragm 54 undergoes flexural displacement according to changes in the differential pressure between the pressure of the ink which is inside the pressure chamber 51 and the atmospheric pressure (the pressure which is received on the outer surface side of the diaphragm 54).

The supply chamber 49 is held in a pressurized state due to the ink which is supplied from the intermediate storage portion 39. When the pressure inside the pressure chamber 51 becomes lower than the atmospheric pressure and the differential pressure between the pressure inside the pressure chamber 51 and the atmospheric pressure becomes greater than a predetermined pressure difference, the valve body 52 enters a state in which the pressure chamber 51 is communicated with the supply chamber 49 from a state in which the communication of the pressure chamber 51 with the supply chamber 49 is restricted by the biasing force of the biasing member 53.

Next, when the differential pressure between the pressure inside the pressure chamber 51 and the atmospheric pressure returns to the predetermined pressure difference due to the ink flowing into the pressure chamber 51 from the supply chamber 49, the valve body 52 restricts the communication between the pressure chamber 51 and the supply chamber 49. In this manner, the pressure adjustment valve 45 adjusts the pressure of the ink which is supplied to the liquid ejecting unit 14 in order to adjust the pressure inside the liquid ejecting unit 14 to become a back pressure of the nozzles 13.

An intra-ejecting unit filter 55 which captures foreign matter such as bubbles and the like which are in the ink which is supplied from the pressure adjustment valve 45 side is provided on the inside of the liquid ejecting unit 14. Therefore, the ink, after passing through the intra-ejecting unit filter 55, is ejected from the nozzles 13 of the liquid ejecting unit 14. The printing of the medium is performed by ejecting the ink toward the medium such as a sheet from the nozzles 13 of the liquid ejecting unit 14 while causing the carriage 46 to move reciprocally along the scanning direction through the driving of the carriage motor (not illustrated).

The liquid supply device 15 of a case in which one type (one color) of the ink is supplied to the liquid ejecting unit 14 is depicted in the ink jet printer 11 of FIG. 1; however, in a case in which a plurality of types (colors) of the ink are used in the ink jet printer 11, the same number of the liquid supply devices 15 as the number of types (the number of colors) of the ink. For example, in a case in which the ink jet printer 11 is a color printer which uses eight colors of ink, eight of the liquid supply devices 15 become necessary. In this case, it is preferable to share the waste liquid tank 33 between the liquid supply devices 15.

Next, description will be given of the electrical configuration of the ink jet printer 11.

Figure 3:
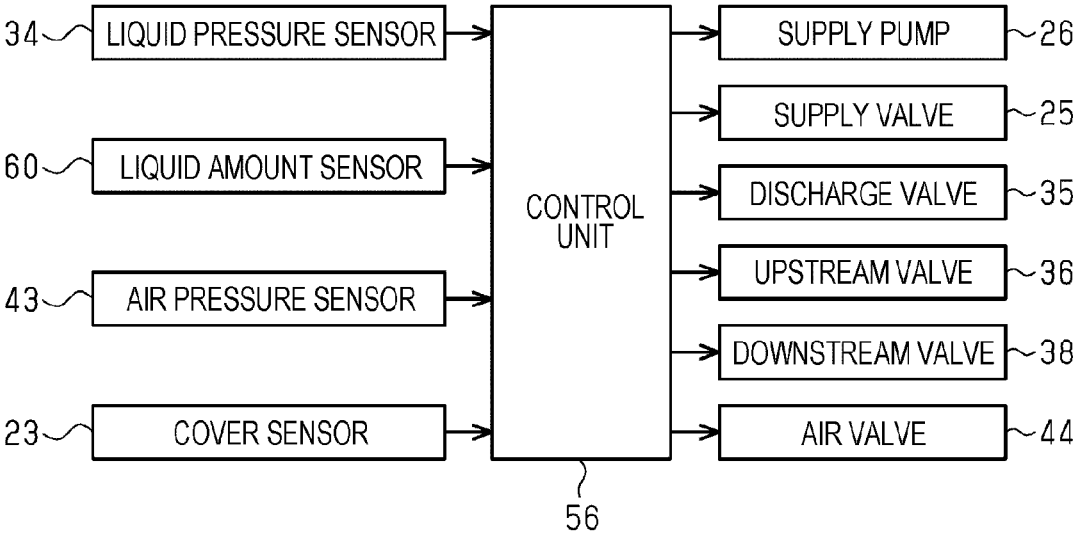
FIG. 3 is a block diagram illustrating the electrical configuration of the ink jet printer.

As illustrated in FIG. 3, the ink jet printer 11 (refer to FIG. 1) is provided with a control unit 56 which performs overall control of the ink jet printer 11. The liquid pressure sensor 34, the liquid amount sensor 60, the air pressure sensor 43, and the cover sensor 23 are electrically connected to the input-side interface (not illustrated) of the control unit 56. Meanwhile, the supply pump 26, the supply valve 25, the discharge valve 35, the upstream valve 36, the downstream valve 38, and the air valve 44 are electrically connected to the output-side interface (not illustrated) of the control unit 56. The control unit 56 individually controls the opening and closing of the supply valve 25, the discharge valve 35, the upstream valve 36, the downstream valve 38, and the air valve 44 in addition to controlling the driving of the supply pump 26 based on the signals which are transmitted from the liquid pressure sensor 34, the liquid amount sensor 60, the cover sensor 23, and the air pressure sensor 43.

Next, detailed description will be given of the configuration of the tank holder 18.

Figure 4:
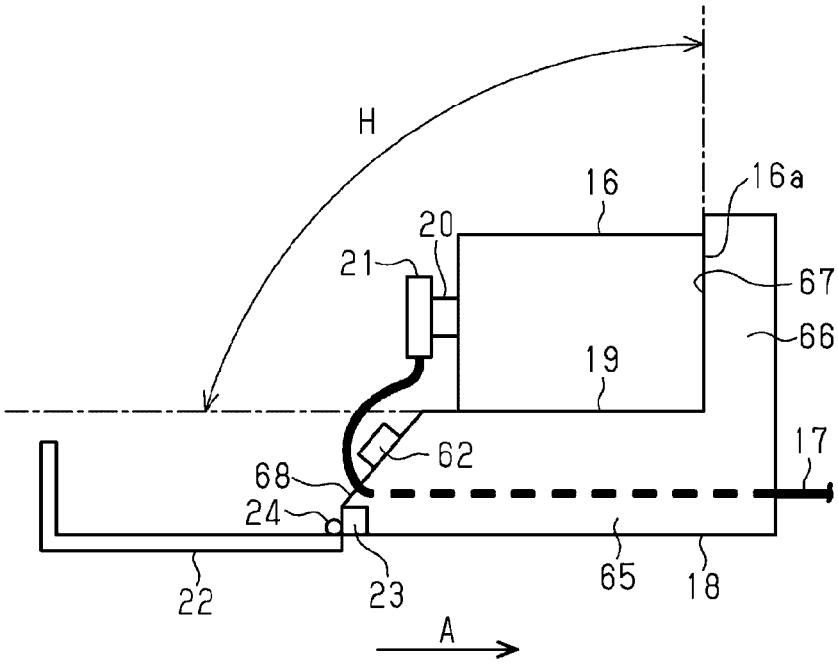
FIG. 4 is a side surface schematic diagram illustrating the configuration of a tank holder.
Figure 7:
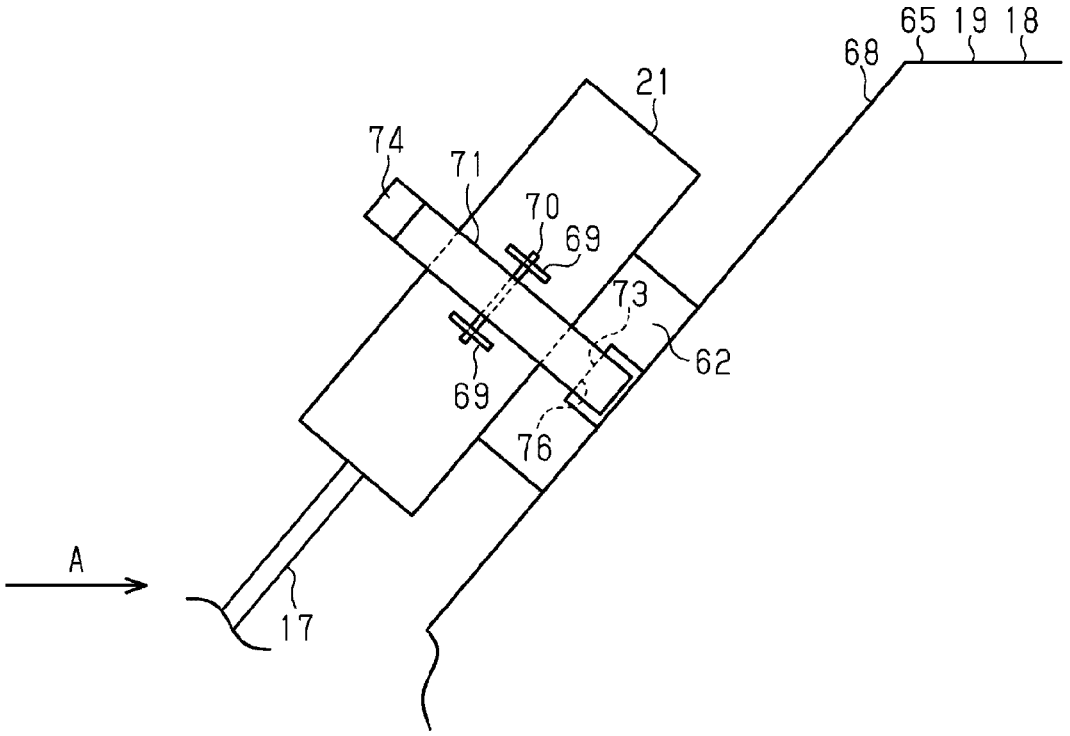
FIG. 7 is a side surface schematic diagram of FIG. 6.

An up-down direction on the paper surface in FIGS. 4 and 7 corresponds to a vertical direction (a gravity direction), and the bottom side in the vertical direction is the bottom side of the paper surface.

As illustrated in FIG. 4, the tank holder 18 has a substantially L character shape as a whole, and is provided with a foundation portion 65, and a back wall portion 66. The top surface of the foundation portion 65 is the mounting surface 19 which is horizontal, and the back wall portion 66 is provided to stand on the end portion of the back side (the right side in FIG. 4) in the foundation portion 65. The surface of the front side (the left side in FIG. 4) on the back wall portion 66 is an abutting surface 67 which is a vertical surface, and the abutting surface 67 is in contact with the mounting surface 19 in a state of being perpendicular thereto. A position (the position illustrated in FIG. 4) when a rear surface 16*a* which is a surface of the back side of the main tank 16 is in contact with the abutting surface 67 in a state in which the main tank 16 is supported on the mounting surface 19 is a setting position in which the main tank 16 is set in the tank holder 18.

The tank holder 18 of the present embodiment is opened over a range from the top side to the front side (the left side in FIG. 4) with respect to the setting position, and the path through which the main tank 16 passes when the main tank 16 is set in the setting position of the tank holder 18 is a setting path. Therefore, the setting path is capable of being a range H from a path which the main tank 16 passes when the main tank 16 is set from the top side with respect to the setting position of the tank holder 18 until a path which the main tank 16 passes when the main tank 16 is set from the left side with respect to the setting position of the tank holder 18.

In the present embodiment, the path through which the main tank 16 passes when the main tank 16 is set from the left side with respect to the setting position of the tank holder 18 is the setting path. In other words, the path through which the main tank 16 passes when the main tank 16 is set at the setting position along the plane including the mounting surface 19 while the rear surface 16*a* of the main tank 16 faces the abutting surface 67 of the back wall portion 66 is the setting path.

Therefore, in the present embodiment, the direction (the direction heading from left to right) which is indicated by the arrow in FIG. 4 is a setting direction A in which the main tank 16 is set in the setting position. In the present embodiment, the liquid outlet portion 20 is disposed on the surface of the opposite side from the rear surface 16*a* in the main tank 16. In other words, the liquid outlet portion 20 is disposed on the surface at the front side in the setting direction A in the main tank 16.

As illustrated in FIGS. 4 and 7, an inclined surface 68 is formed at the front side (the left side in FIGS. 4 and 7) in the setting direction A in the foundation portion 65 so as to be in contact with the mounting surface 19. The inclined surface 68 is inclined such that the height decreases toward the front side in the setting direction A, and the connection body holding portion 62 is provided on the inclined surface 68.

In this case, in the connection body holding portion 62, the connection body 21 which is held by the connection body holding portion 62 and the connection body holding portion 62 are provided to be positioned below the plane which includes the mounting surface 19. In other words, in the connection body holding portion 62, the connection body 21 which is held by the connection body holding portion 62 and the connection body holding portion 62 are provided to deviate from the setting path which is passed through when the main tank 16 is set in the setting position of the tank holder 18. Furthermore, in this case, the connection body holding portion 62 is provided closer to the front side in the setting direction A with respect to the tank holder 18 of the main tank 16 than the main tank 16 which is set in the setting position of the tank holder 18.

Figure 5:
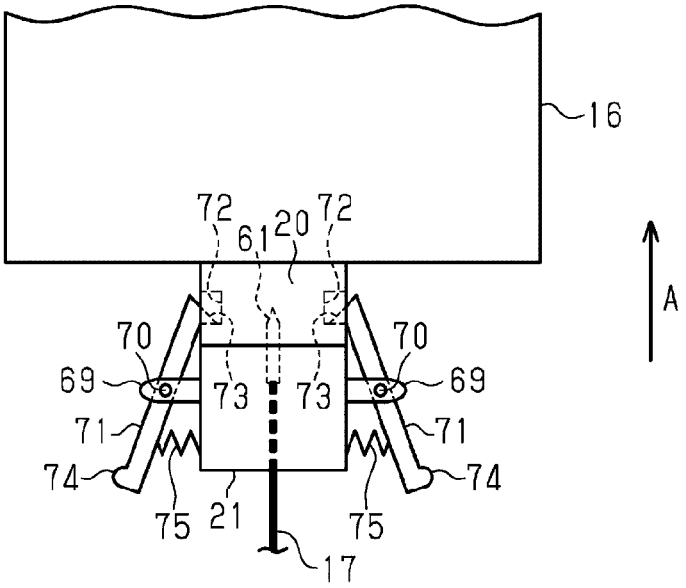
FIG. 5 is a schematic plan diagram illustrating a connection state between a connection body and a liquid outlet portion.

As illustrated in FIG. 5, bearing portions 69 are provided on both side surfaces of the connection body 21 to form a pair. A rod-shaped lever member 71 is supported, via a support shaft 70, to be capable of rotating on the center portion of each of the bearing portions 69 which form a pair. A claw portion 73 is formed on one end portion of each of the lever members 71. The claw portion 73 is an example of a locking-target portion which is locked to an outlet portion side locking recessed portion 72 which is an example of a locking portion which is formed on both side surfaces of the liquid outlet portion 20 of the main tank 16. Meanwhile, an operation unit 74 is formed on the other end portion of each of the lever members 71.

Figure 6:
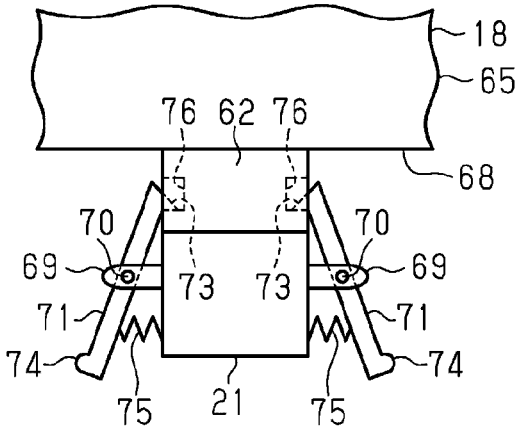
FIG. 6 is a schematic plan diagram illustrating a connection state between the connection body and the connection body holding portion.

FIGS. 5 and 6 are plan diagrams illustrating the connection state between the connection body 21 and the liquid outlet portion 20 in FIG. 4, as viewed from above in the gravity direction.

A spring 75 is provided between each side surface of the connection body 21 and a position which is closer to the operation unit 74 side than the support shaft 70 on each of the lever members 71. The springs 75 bias the lever members 71 such that the operation units 74 of the lever members 71 separate from each other. Therefore, the lever members 71 are rotated in a direction in which the claw portions 73 approach each other due to the biasing force of the springs 75.

After connecting the liquid introduction portion 61 to the liquid outlet portion 20 in a state in which the lever members 71 are rotated in a direction in which the operation units 74 approach each other against the biasing force of the springs 75 by pinching the operation units 74, when the lever members 71 are rotated in directions in which the operation units 74 separate from each other by using the biasing force of the springs 75, the claw portions 73 are locked to the outlet portion side locking recessed portions 72. Accordingly, a state in which the liquid introduction portion 61 of the connection body 21 is connected to the liquid outlet portion 20 is maintained.

Meanwhile, when the lever members 71 are rotated in the direction in which the operation units 74 approach each other against the biasing force of the springs 75 by pinching the operation units 74 in a state in which the claw portions 73 of the lever members 71 are locked to the outlet portion side locking recessed portions 72, the locking state between the claw portions 73 and the outlet portion side locking recessed portions 72 is released. Therefore, the connection body 21 can be said to include the claw portions 73 and the operation units 74. The claw portions 73 are locked to the outlet portion side locking recessed portions 72 of the liquid outlet portion 20 of the main tank 16 in a state in which the liquid introduction portion 61 is connected to the liquid outlet portion 20, and the operation units 74 are operated by being pinched to cause the locking state between the claw portions 73 and the outlet portion side locking recessed portions 72 to be released.

As illustrated in FIGS. 6 and 7, a holding portion side locking recessed portion 76 which is capable of locking the claw portion 73 of each of the lever members 71 is formed on each side surface of the connection body holding portion 62. After connecting the connection body 21 to connection body holding portion 62 in a state in which the lever members 71 are rotated in a direction in which the operation units 74 approach each other against the biasing force of the springs 75 by pinching the operation units 74, when the lever members 71 are rotated in directions in which the operation units 74 separate from each other by using the biasing force of the springs 75, the claw portions 73 are locked to the holding portion side locking recessed portions 76.

Accordingly, the connection body 21 is held by the connection body holding portion 62. In this case, the connection body holding portion 62 holds the connection body 21 in a posture at which the operation units 74 are closer to the front side (the left side in FIG. 7) in the setting direction A with respect to the tank holder 18 of the main tank 16 than the claw portions 73. Meanwhile, when the lever members 71 are rotated in the direction in which the operation units 74 approach each other against the biasing force of the springs 75 by pinching the operation units 74 in a state in which the claw portions 73 of the lever members 71 are locked to the holding portion side locking recessed portions 76, the locking state between the claw portions 73 and the holding portion side locking recessed portions 76 is released.

Figure 8:
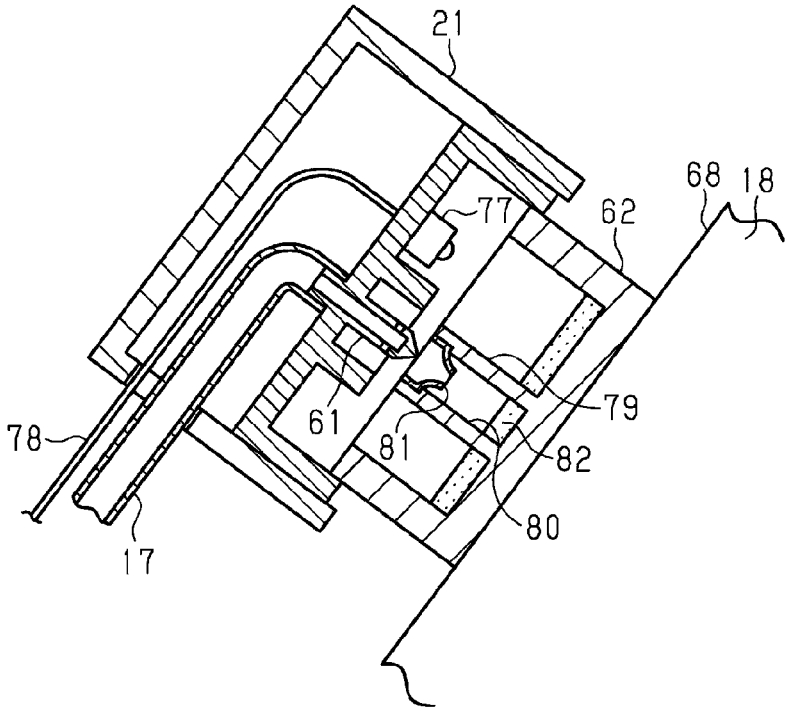
FIG. 8 is a schematic sectional diagram illustrating a state when connecting the connection body and a connection body holding portion.

As illustrated in FIG. 8, the connection body 21 includes an electrical connection portion 77 to which the main tank 16 is connected, and the electrical connection portion 77 is electrically connected to the control unit 56 (refer to FIG. 3) via an electrical wire 78. The connection body holding portion 62 is provided with a housing portion 79 and a cap portion 80. The housing portion 79 is capable of housing the electrical connection portion 77 and has a bottom-inclusive box shape, and the cap portion 80 covers the liquid introduction portion 61 or a space including the liquid introduction portion 61 and has a bottom-inclusive box shape. An elastic member 81 is provided on the opening portion of the cap portion 80. The elastic member 81 is ring-shaped sealing rubber or the like which closely adheres to the liquid introduction portion 61 when the liquid introduction portion 61 is inserted into the cap portion 80. An absorbing member 82 which is capable of absorbing and holding a liquid such as the ink which drips from the liquid introduction portion 61 is disposed on the entirety of the bottom portion of the inside of the connection body holding portion 62.

Figure 9:
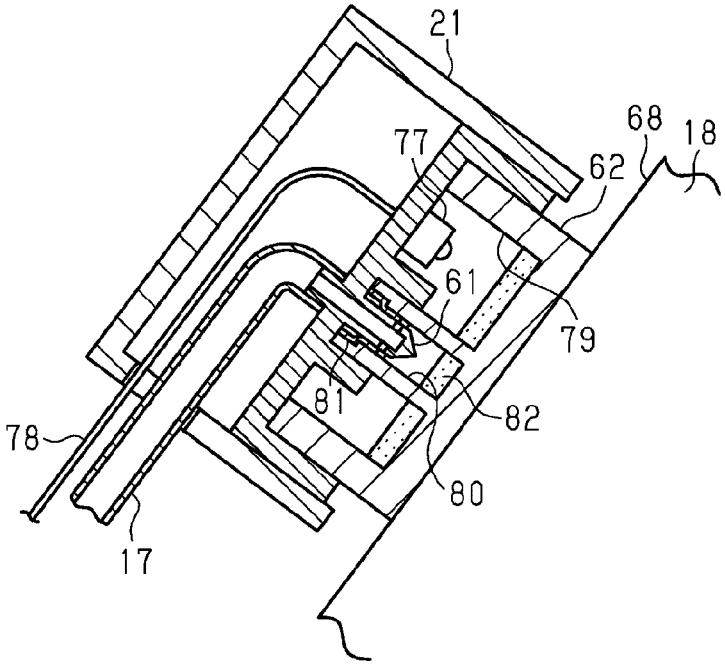
FIG. 9 is a schematic sectional diagram illustrating a state when connecting the connection body and the connection body holding portion.

As illustrated in FIG. 9, the electrical connection portion 77 is positioned closer to the top side than the liquid introduction portion 61 in a state in which the connection body holding portion 62 holds the connection body 21 such that the liquid introduction portion 61 and the electrical connection portion 77 are housed by the cap portion 80 and the housing portion 79, respectively. In other words, the connection body holding portion 62 holds the connection body 21 in a posture at which the electrical connection portion 77 is closer to the top side than the liquid introduction portion 61.

An up-down direction on the paper surface in FIGS. 8 and 9 corresponds to a vertical direction (a gravity direction), and the bottom side in the vertical direction is the bottom side of the paper surface.

Next, description will be given of the operations during the exchanging of the main tank 16 in the ink jet printer 11.

In a case in which the exchanging of the main tank 16 is performed, first, the cover 22 is opened. When the cover sensor 23 detects that the cover 22 is opened, since there is a possibility that the liquid introduction portion 61 of the connection body 21 is removed from the liquid outlet portion 20 of the main tank 16 regardless or the presence or absence of the exchanging work of the main tank 16, the control unit 56 closes the supply valve 25 and stops the supply pump 26.

Next, when the lever members 71 are rotated in the direction in which the operation units 74 approach each other against the biasing force of the springs 75 by pinching the operation units 74 of the lever members 71 of the connection body 21, a state is assumed in which the locking state between the claw portions 73 and the outlet portion side locking recessed portions 72 is released. In this state, when the connection body 21 is pulled in the opposite direction (the left side in FIG. 4) from the setting direction A, the connection body 21 is removed from the liquid outlet portion 20 of the main tank 16.

At this time, since the supply valve 25 is closed and the supply pump 26 is stopped, the negative pressure which arises on closer to the upstream side than the supply valve 25 inside the liquid supply path 17 does not become significantly greater. Therefore, when the connection body 21 is removed from the liquid outlet portion 20 of the main tank 16, almost no air is pulled into the liquid supply path 17 from the liquid introduction portion 61 of the connection body 21.

Next, after connecting the connection body 21 which is removed from the liquid outlet portion 20 of the main tank 16 to connection body holding portion 62, when the lever members 71 of the connection body 21 are rotated in directions in which the operation units 74 separate from each other by using the biasing force of the springs 75, the claw portions 73 are locked to the holding portion side locking recessed portions 76. Accordingly, since the connection body 21 is held by the connection body holding portion 62, the liquid introduction portion 61 of the connection body 21 does not come into contact with another member to dirty the other member with the ink.

Next, the old main tank 16 which is in the setting position of the tank holder 18 is moved in the opposite direction (the left side in FIG. 4) from the setting direction A along the setting path to remove the old main tank 16 from the tank holder 18. Next, the new main tank 16 is moved in the setting direction A (the right side in FIG. 4) along the setting path to set the new main tank 16 in the setting position of the tank holder 18.

At this time, the connection body 21 which is held by the connection body holding portion 62 and the connection body holding portion 62 are in a position which is separated from the setting path which is a position which is lower than a plane including the mounting surface 19, and thus, when the old main tank 16 which is in the setting position is exchanged for the new main tank 16, the connection body 21 which is held by the connection body holding portion 62 and the connection body holding portion 62 do not interfere with the exchanging. Therefore, it is possible to easily perform the exchanging work of the main tank 16 which is in the setting position of the tank holder 18.

Next, when the lever members 71 are rotated in the direction in which the operation units 74 approach each other against the biasing force of the springs 75 by pinching the operation units 74 of the lever members 71 of the connection body 21, a state is assumed in which the locking state between the claw portions 73 and the holding portion side locking recessed portion 76 is released. In this state, when the connection body 21 is pulled from the connection body holding portion 62, the connection body 21 is removed from the connection body holding portion 62.

Next, after connecting the connection body 21 (the liquid introduction portion 61) which is removed from the connection body holding portion 62 to the liquid outlet portion 20 of the main tank 16, when the lever members 71 are rotated in directions in which the operation units 74 separate from each other by using the biasing force of the springs 75, the claw portions 73 are locked to the outlet portion side locking recessed portions 72. Accordingly, a state in which the liquid introduction portion 61 of the connection body 21 is connected to the liquid outlet portion 20 is maintained. Subsequently, the exchanging work of the main tank 16 is completed by closing the cover 22.

Next, description is given of the operations of the ink jet printer 11.

When the ink which is supplied from the liquid ejecting unit 14 via the liquid supply path 17 from the main tank 16 through the driving of the supply pump 26 is ejected toward a medium from the nozzles 13 to perform the printing, the bubbles which are collected by the filter 29 of the filter portion 27 are retained inside the upstream side filter chamber 30. In a case in which the bubbles which are retained inside the upstream side filter chamber 30 are discharged, first, when the discharge valve 35 which is closed is opened, the discharge flow path 32 assumes a state of being communicated with the outside.

When the supply pump 26 is driven in this state, the bubbles which are retained inside the upstream side filter chamber 30 are discharged to the waste liquid tank 33 via the discharge flow path 32 together with the ink. At this time, since the upstream end of the discharge flow path 32 is connected to the top end portion at which the bubbles are most easily collected in the upstream side filter chamber 30, the bubbles which are retained inside the upstream side filter chamber 30 are discharged to the waste liquid tank 33 smoothly and efficiently. Therefore, since the ink amount which is discharged into the waste liquid tank 33 together with the bubbles is little, wasteful consumption of the ink is suppressed.

Since the supply pump 26 is driven in a state in which the discharge valve 35 is closed during the printing, even if the supply pump 26 is stopped after the printing, the state in which the inside of the liquid supply path 17 is pressurized continues. Alternatively, even if the printing is not performed, when the temperature of the outside rises in a state in which the discharge valve 35 is closed, the inside of the liquid supply path 17 assumes a pressurized state. When the inside of the liquid supply path 17 is pressurized and the pressure inside the liquid supply path 17 becomes too great, various problems arise. Therefore, in a case in which the inside of the liquid supply path 17 assumes a pressurized state as described above, by switching from the non-communicating state in which the discharge flow path 32 is not communicated with the outside to the communicating state in which the discharge flow path 32 is communicated with the outside by opening the discharge valve 35 which is closed, it is possible to release the pressurized state inside the liquid supply path 17.

Since the ink does not easily pass through the filter 29 when the filter 29 becomes clogged, when the supply pump 26 is driven when the discharge flow path 32 is in the non-communicating state with the outside (the state in which the discharge valve 35 is closed), the pressure of the upstream side filter chamber 30 increases. At this time, since the pressure of the upstream side filter chamber 30 is detected by the liquid pressure sensor 34, the degree of clogging of the filter 29 is estimated by an estimation unit 59 based on the pressure which is detected by the liquid pressure sensor 34. In this case, in a case in which the pressure which is detected by the liquid pressure sensor 34 is higher than a threshold S, the estimation unit 59 estimates that the degree of clogging of the filter 29 is a state (an exchanging time of the filter 29) in which it is necessary to exchange the filter 29.

Furthermore, in this case, by storing a table indicating the relationship between the pressure of the upstream side filter chamber 30 and the degree of clogging of the filter 29 which are obtained based on experiments and simulations which are performed in advance in a memory 58, it becomes possible to perform supply control or the like of the ink according to the degree of clogging of the filter 29 based on the table.

According to the embodiment which is described in detail above, it is possible to obtain the following effects.

(1) The liquid supply device 15 is provided with the connection body holding portion 62 which holds the connection body 21 in a state in which the connection of the liquid introduction portion 61 with the liquid outlet portion 20 is released. Therefore, since the connection body 21 which is in a state in which the connection of the liquid introduction portion 61 with the liquid outlet portion 20 is released is held in a determined position by the connection body holding portion 62, it is possible to easily set the main tank 16 in the tank holder 18.

(2) In the liquid supply device 15, in the connection body holding portion 62, the connection body 21 which is held by the connection body holding portion 62 and the connection body holding portion 62 are provided to deviate from the setting path which is passed through when the main tank 16 is set in the setting position of the tank holder 18. Therefore, since the connection body 21 and the connection body holding portion 62 do not interfere when setting the main tank 16 in the tank holder 18, it is possible to easily set the main tank 16 in the tank holder 18.

(3) In the liquid supply device 15, in the connection body holding portion 62, the connection body 21 which is held by the connection body holding portion 62 and the connection body holding portion 62 are provided to be positioned below the plane which includes the mounting surface 19. Therefore, since the connection body 21 and the connection body holding portion 62 do not interfere when mounting the main tank 16 on the mounting surface 19, it is possible to easily set the main tank 16 in the tank holder 18.

(4) In the liquid supply device 15, the connection body holding portion 62 is provided closer to the front side of the setting direction A with respect to the tank holder 18 of the main tank 16 than the main tank 16 which is set (supported) in the setting position of the tank holder 18. Therefore, after setting the main tank 16 in the tank holder 18, it is possible to easily connect the liquid introduction portion 61 of the connection body 21 to the liquid outlet portion 20 of the main tank 16.

(5) In the liquid supply device 15, the connection body holding portion 62 holds the connection body 21 in a posture at which the operation units 74 are closer to the front side (the left side in FIG. 7) in the setting direction A than the claw portions 73. Therefore, it is possible to easily remove the connection body 21 from the connection body holding portion 62 when connecting the connection body 21 (the liquid introduction portion 61) to the liquid outlet portion 20 of the main tank 16, and it is possible to easily cause the connection body holding portion 62 to hold the connection body 21 which is removed from the liquid outlet portion 20.

(6) In the liquid supply device 15, the connection body 21 includes the electrical connection portion 77 to which the main tank 16 is connected, and the connection body holding portion 62 holds the connection body 21 in a posture at which the electrical connection portion 77 is closer to the top side than the liquid introduction portion 61. Therefore, in a case in which the ink leaks out from the liquid introduction portion 61 or a similar event occurs, it is possible to suppress the adherence of the ink which leaks out to the electrical connection portion 77.

(7) In the liquid supply device 15, the connection body holding portion 62 includes the cap portion 80 which covers the liquid introduction portion 61 or a space which includes the liquid introduction portion 61. Therefore, it is possible to suppress the evaporation of the solvent component of the ink from the liquid introduction portion 61 which is not connected to the liquid outlet portion 20 which leads to the viscosity of the ink being increased, foreign matter such as dust adhering to the liquid introduction portion 61, and the like.

(8) The ink jet printer 11 is provided with the discharge flow path 32 which is connected to the upstream side filter chamber 30 of the filter portion 27 and which is capable of discharging the ink which includes bubbles inside the liquid supply path 17 to the outside. Therefore, since it is possible to discharge the bubbles which are retained in the upstream side filter chamber 30 from the discharge flow path 32 directly to the outside, it is possible to efficiently discharge the bubbles which are inside the liquid supply path 17 in which the filter 29 is disposed.

(9) In the ink jet printer 11, the supply pump 26 which supplies the ink to the liquid ejecting unit 14 side is provided in a position which is closer to the main tank 16 side than the filter portion 27 in the liquid supply path 17. Therefore, it is possible to smoothly supply the ink from the main tank 16 to the liquid ejecting unit 14 by driving the supply pump 26.

(10) The ink jet printer 11 is provided with the control unit 56 which controls the supply pump 26, and the control unit 56 drives the supply pump 26 in a state in which the discharge flow path 32 is communicated with the outside. Therefore, it is possible to discharge the ink (the fluid) which includes the bubbles inside the liquid supply path 17 from the discharge flow path 32 to the outside by driving the supply pump 26 by using the control unit 56.

(11) The ink jet printer 11 is provided with the discharge valve 35 which is capable of being switched between a communicating state in which the discharge flow path 32 is communicated with the outside, and a non-communicating state in which the discharge flow path 32 is not communicated with the outside. Therefore, using the opening and closing operations of the discharge valve 35, the discharge valve 35 is capable of being switched between the communicating state in which the discharge flow path 32 is communicated with the outside, and the non-communicating state in which the discharge flow path 32 is not communicated with the outside.

(12) The ink jet printer 11 is provided with the control unit 56 which controls the discharge valve 35, and the control unit 56 controls the discharge valve 35 to switch from the non-communicating state to the communicating state in a state in which the inside of the liquid supply path 17 is pressurized. Therefore, by switching to the communicating state in which the discharge flow path 32 is communicated with the outside by controlling the discharge valve 35 by using the control unit 56, it is possible to discharge the ink (the fluid) which includes the bubbles inside the liquid supply path 17 from the discharge flow path 32 to the outside.

(13) The ink jet printer 11 is provided with the liquid pressure sensor 34 which detects the pressure inside the liquid supply path 17. Therefore, it is possible to detect the pressure inside the liquid supply path 17 by using the liquid pressure sensor 34.

(14) The ink jet printer 11 is provided with the estimation unit 59 which estimates the degree of clogging of the filter 29 based on the pressure which is detected by the liquid pressure sensor 34 in a state in which the supply pump 26 is driven when the discharge flow path 32 is in the non-communicating state with respect to the outside. Therefore, since it is possible to estimate the degree of clogging of the filter 29 using the liquid pressure sensor 34 by using the estimation unit 59, it is possible to perform supply control of the ink and the estimation of the exchanging time of the filter 29 according to the degree of clogging of the filter 29.

(15) In the ink jet printer 11, in a case in which the pressure which is detected by the liquid pressure sensor 34 is higher than a threshold S which is set, the estimation unit 59 estimates that the degree of clogging of the filter 29 is a state in which it is necessary to exchange the filter 29. Therefore, it is possible to estimate the exchanging time of the filter 29.

(16) In the ink jet printer 11, the liquid pressure sensor 34 is provided in the discharge flow path 32. Therefore, since it becomes difficult for the liquid pressure sensor 34 to detect minute pressure fluctuations (a pulse of the ink) which becomes noise inside the liquid supply path 17 and is caused by the driving of the supply pump 26, it is possible to accurately detect the pressure inside the liquid supply path 17.

Modification Example

Furthermore, the embodiment described above may also be modified as described below.

Figure 10:
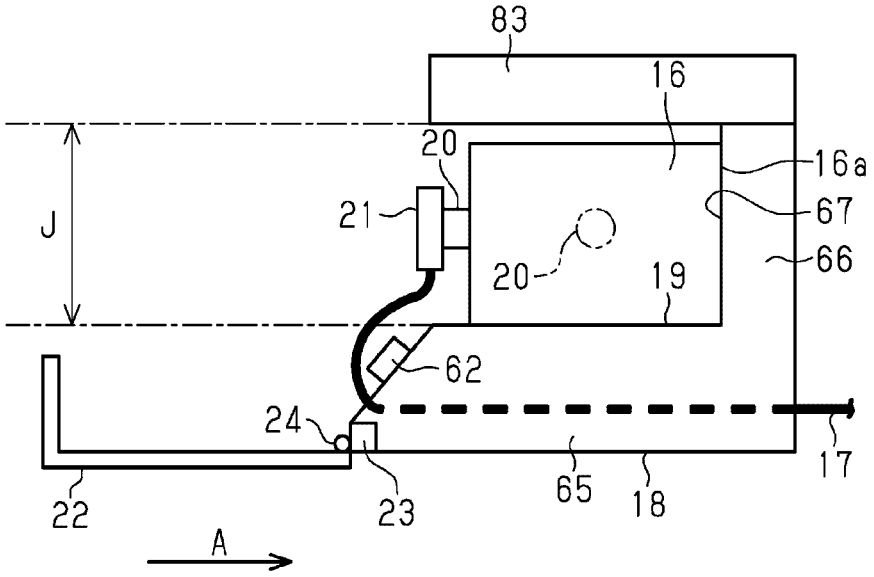
FIG. 10 is a side surface schematic diagram illustrating a state when setting a main tank in a tank holder of a modification example.

As illustrated in FIG. 10, a top wall portion 83 which covers the top side of the main tank 16 which is set in the setting position of the tank holder 18 may be provided on the top end portion of the back wall portion 66 of the tank holder 18. In this case, the setting path is configured by a path which is inside a region J between a plane including the bottom surface of the top wall portion 83 and a plane including the mounting surface 19, and is a path through which the main tank 16 passes when the rear surface 16*a* of the main tank 16 is set in the setting position while facing the abutting surface 67 of the back wall portion 66.

As illustrated by the double-dot-dash line of FIG. 10, the liquid outlet portion 20 may be provided on the side surface of the main tank 16.

Figure 11:
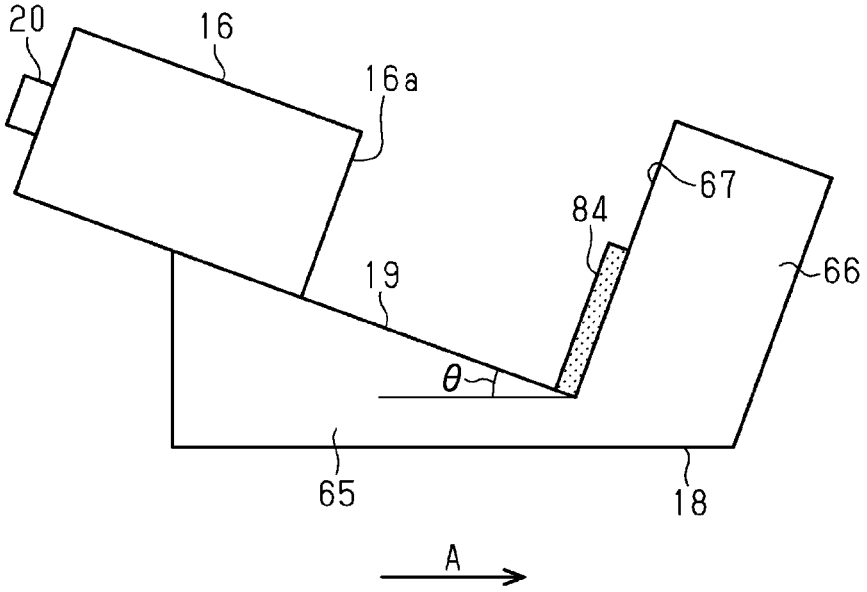
FIG. 11 is a side surface schematic diagram illustrating a state when setting a main tank in a tank holder of a modification example.
Figure 12:
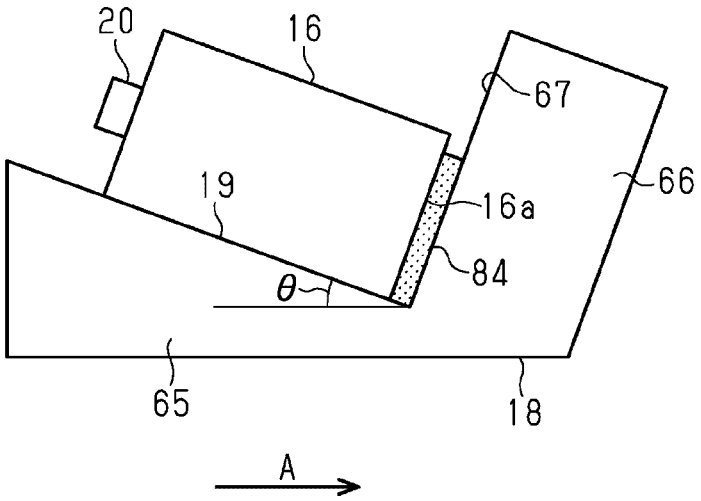
FIG. 12 is a side surface schematic diagram illustrating a state when setting the main tank in the tank holder in FIG. 11.

As illustrated in FIG. 11, in the liquid supply device 15, the mounting surface 19 of the tank holder 18 may be inclined such that the back side (the right side in FIG. 11) in the setting direction A is lower than the front side (the left side in FIG. 11) in the setting direction A with respect to the tank holder 18 of the main tank 16. In this case, it is preferable that the abutting surface 67 of the back wall portion 66 is inclined so as to form a right angle with the mounting surface 19, and buffering material 84 is disposed on the abutting portion of the main tank 16 in the abutting surface 67. If this configuration is adopted, as illustrated in FIG. 12, it is possible to easily move the main tank 16 to the setting position while sliding on the mounting surface 19 using the weight of the main tank 16. An inclination angle $\theta$ of the mounting surface 19 is set to satisfy the expression $\mu<\tan\theta$ which is derived from the expression $Mg\cdot\sin\theta>\mu Mg\cdot\cos\theta$. In this case, M indicates the mass including the ink in the inner portion of the main tank 16, g indicates gravitational acceleration, and $\mu$ indicates a static friction coefficient of the main tank 16.

Figure 13:
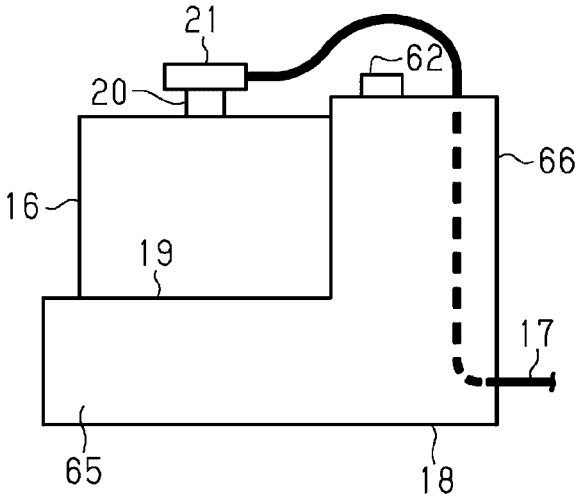
FIG. 13 is a side surface schematic diagram illustrating a state when setting a main tank in a tank holder of a modification example.

As illustrated in FIG. 13, the liquid outlet portion 20 may be provided on the top surface of the main tank 16. In this case, it is preferable that the connection body holding portion 62 be disposed on the top surface of the back wall portion 66 of the tank holder 18. Furthermore, in this case, the main tank 16 may be disposed on the top surface of the ink jet printer 11.

Figure 14:
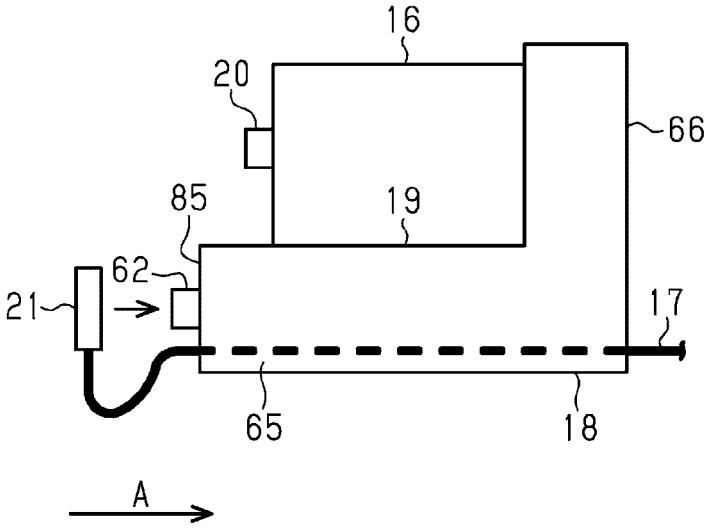
FIG. 14 is a side surface schematic diagram illustrating a state when setting a main tank in a tank holder of a modification example.

As illustrated in FIG. 14, a configuration may be adopted in which a vertical surface 85 which is perpendicular to the mounting surface 19 may be provided instead of the inclined surface 68 on the front side (the left side in FIG. 14) of in the setting direction A in the foundation portion 65 of the tank holder 18, and the connection body holding portion 62 may be disposed on the vertical surface 85.

Figure 15:
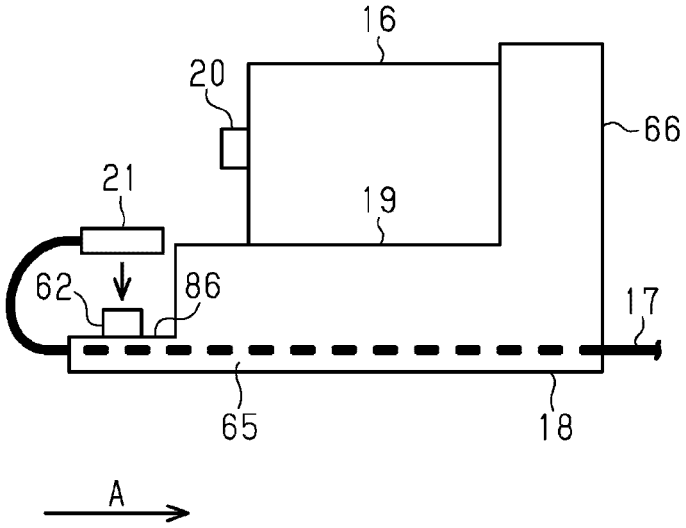
FIG. 15 is a side surface schematic diagram illustrating a state when setting a main tank in a tank holder of a modification example.

As illustrated in FIG. 15, a configuration may be adopted in which a horizontal surface 86 which is provided at a lower position than the mounting surface 19 with a level difference with respect to the mounting surface 19 instead of the inclined surface 68 on the front side (the left side in FIG. 15) of in the setting direction A in the foundation portion 65 of the tank holder 18, and the connection body holding portion 62 may be disposed on the horizontal surface 86. In this case, it is preferable that the height of the horizontal surface 86 be set such that the connection body 21 which is held by the connection body holding portion 62 and the connection body holding portion 62 are lower than the mounting surface 19.

An up-down direction on the paper surface in FIGS. 10 to 15 corresponds to a vertical direction (a gravity direction), and the bottom side in the vertical direction is the bottom side of the paper surface.

The cap portion 80 of the connection body holding portion 62 may be omitted.

It is not necessary for the connection body holding portion 62 to hold the connection body 21 in a posture at which the electrical connection portion 77 is closer to the top side than the liquid introduction portion 61. In other words, the connection body holding portion 62 may hold the connection body 21 in a posture at which the electrical connection portion 77 is closer to the bottom side than the liquid introduction portion 61, for example.

It is not necessary for the connection body holding portion 62 to hold the connection body 21 in a posture at which the operation units 74 are closer to the front side (the left side in FIG. 7) in the setting direction A than the claw portions 73.

It is not necessary for the connection body holding portion 62 to be provided closer to the front side in the setting direction A than the main tank 16 which is set (supported) in the setting position of the tank holder 18.

In the connection body holding portion 62, it is not necessary for the connection body 21 which is held by the connection body holding portion 62 and the connection body holding portion 62 to be provided to be positioned below the plane which includes the mounting surface 19.

In the connection body holding portion 62, it is not necessary for the connection body 21 which is held by the connection body holding portion 62 and the connection body holding portion 62 to be provided to deviate from the setting path which is passed through when the main tank 16 is set in the tank holder 18.

The supply pump 26 may be omitted. In this case, it is preferable to supply the ink of the main tank 16 to the liquid ejecting unit 14 side using pressurization by using air pressure, for example. Alternatively, the ink of the main tank 16 may be supplied to the liquid ejecting unit 14 side using a hydraulic head difference.

The control unit 56 may control the discharge valve 35 such that the discharge flow path 32 switches from the non-communicating state to the communicating state with respect to the outside in a state in which the inside of the liquid supply path 17 is pressurized before a filter clogging estimation operation which is executed when estimating the degree of clogging of the filter 29 by using the estimation unit 59. Before a filter clogging estimation operation which is executed by the estimation unit 59, the control unit 56 may open the discharge valve 35 which is closed in a state in which the inside of the liquid supply path 17 is pressurized to cause the bubbles of the upstream side filter chamber 30 to be discharged from the discharge flow path 32 together with the ink. If this configuration is adopted, since the filter clogging estimation operation is executed after the bubbles of the upstream side filter chamber 30 are discharged from the discharge flow path 32, it is possible to suppress erroneous estimation in the filter clogging estimation operation by the estimation unit 59 which is caused by the bubbles. Therefore, it is possible to estimate the degree of clogging of the filter with a higher accuracy.

The control unit 56 may control the discharge valve 35 to switch from the non-communicating state to the communicating state when the power of the ink jet printer 11 is turned off. If this configuration is adopted, since the inside of the liquid supply path 17 is opened to the atmosphere when the power of the ink jet printer 11 is turned off, it is possible to suppress the pressure of the inside of the liquid supply path 17 from rising due to receiving influence of environmental changes in the periphery when the ink jet printer 11 is not being used, and the like.

A configuration may be adopted in which the control unit 56 recognizes that the ink of the main tank 16 is empty in a case in which an empty value, which is a pressure detection value of the liquid pressure sensor 34 when the ink of the main tank 16 is empty, is obtained in advance experimentally or by simulation and stored in the memory 58, and the pressure detection value of the liquid pressure sensor 34 becomes the empty value.

In a case in which, even if the control unit 56 drives the supply pump 26 for only a time which is sufficient to render the inside of the intermediate storage portion 39 a state in which the tank is full of the ink, the state in which the inside of the intermediate storage portion 39 is full of the ink is not detected by the liquid amount sensor 60, the ink of the main tank 16 may be estimated to be empty.

The control unit 56 may estimate erroneous operations of the valves 25, 35, 36, 38, and 44 and ink leaking from the liquid supply path 17 by combining the driving of the liquid pressure sensor 34 and the supply pump 26, soft count values of the liquid amount sensor 60 and the ink amount of the main tank 16, and the opening and closing operations of the valves 25, 35, 36, 38, and 44.

In a case in which the ink type which is handled by the liquid supply device 15 is modified, the old ink from before the modification inside the intermediate storage portion 39 may be discharged from the discharge flow path 32. In this case, the intermediate storage portion 39 is pushes by the pushing portion 40 in a state in which the supply valve 25 and the downstream valve 38 are closed and the discharge valve 35 and the upstream valve 36 are opened to pressurize the old ink before the modification inside the intermediate storage portion 39, and thus, the ink inside the intermediate storage portion 39 is smoothly discharged from the discharge flow path 32. If this configuration is adopted, since it is possible to discharge the old ink from before the modification inside the intermediate storage portion 39 without passing the ink through the liquid ejecting unit 14, it is possible to reduce the load in the subsequent cleaning process of the liquid ejecting unit 14.

In a case in which the cover 22 is opened by the user in order to exchange the main tank 16, for example, the control unit 56 may close the supply valve 25 and stop the supply pump 26. If this configuration is adopted, when the connection body 21 is removed from the liquid outlet portion 20 of the main tank 16, it is possible to suppress the air being pulled into the liquid supply path 17 from the connection body 21.

The filter 29 may have a plate shape in which the space inside the case 28 is partitioned into two chambers on the upstream side and the downstream side. In this case, the chamber of the upstream side becomes the upstream side filter chamber.

It is not necessary to provide the liquid pressure sensor 34 in the discharge flow path 32. In other words, the liquid pressure sensor 34 may be provided in the liquid supply path 17. In this case, the liquid pressure sensor 34 may be provided in a position between the supply pump 26 and the upstream side filter chamber 30 in the liquid supply path 17.

In a case in which the pressure which is detected by the liquid pressure sensor 34 is higher than the threshold S which is set, it is not necessary for the estimation unit 59 to estimate that the degree of clogging of the filter 29 is a state in which it is necessary to exchange the filter 29.

The estimation unit 59 may be omitted.

The liquid pressure sensor 34 may be omitted.

The control unit 56 may be omitted.

The discharge valve 35 may be omitted.

As long as the liquid supply device 15 is provided with the tank holder 18, the connection body 21, the connection body holding portion 62, and the liquid supply path 17, the other configurations such as the pressure adjustment valve 45 may not be provided in the liquid supply path 17.

In the embodiments described above, the liquid ejecting apparatus may also be a liquid ejecting apparatus which ejects or discharges a liquid other than ink. The state of the liquid which is discharged as minute droplets from the liquid ejecting apparatus includes liquids of a droplet shape, a tear shape, and liquid which forms a line-shaped tail. The liquid referred to here may be a material which can be ejected from a liquid ejecting apparatus. For example, the liquid may be a material which is in a liquid phase state, and includes liquid bodies of high or low viscosity, and fluid bodies such as sol, aqueous gel, other inorganic solvents, organic solvents, solutions, liquid resin, and liquid metal (molten metal). The liquid not only includes liquids as a state of a material, but also includes solutions, disperses and mixtures in which particles of functional material formed from solids such as pigments and metal particulate are dissolved, dispersed or mixed into a solvent. Representative examples of the liquid include various liquid compositions such as an aqueous ink such as that described in the embodiment, a non-aqueous ink, an oil-based ink, a gel ink, and a hot melt ink, and liquid crystal. A specific example of the liquid ejecting apparatus is a liquid ejecting apparatus which ejects a liquid which contains a material such as an electrode material or a color material in the form of a dispersion or a solution. The electrode material and the color material may be used in the manufacture and the like of liquid crystal displays, EL (electro-luminescence) displays, surface emission displays and color filters. The liquid ejecting apparatus may also be a liquid ejecting apparatus which ejects biological organic matter which is used in the manufacture of bio-chips, a liquid ejecting apparatus which is used as a precision pipette to eject a liquid to be a sample, a textile printing apparatus, a micro dispenser, or the like. The liquid ejecting apparatus may also be a liquid ejecting apparatus which ejects a lubricant at pinpoint precision into precision machines such as clocks and cameras, or a liquid ejecting apparatus which ejects a transparent resin liquid such as ultraviolet curing resin onto a substrate in order to form minute semispherical lenses (optical lenses) which are used in optical communication elements and the like. The liquid ejecting apparatus may also be a liquid ejecting apparatus which ejects an acidic or alkaline etching liquid for etching a substrate or the like.

The entire disclosure of Japanese Patent Application No. 2016-139147, filed Jul. 14, 2016 and No. 2016-136692, filed Jul. 11, 2016 are expressly incorporated by reference herein.

What is claimed is:

1. A liquid supply device which supplies a liquid to a liquid ejecting unit which ejects the liquid, the liquid supply device comprising:

a connection body that includes a liquid introduction portion that is configured to removably connect a liquid outlet portion of a liquid container, wherein the liquid container contains the liquid that is supplied to the liquid ejecting unit, wherein the connection body is configured to guide the liquid out of the liquid container;

a liquid container support portion that is capable of supporting the liquid container in a state in which the liquid introduction portion is capable of being connected to the liquid outlet portion to be capable of being freely attached and detached; and a connection body holding portion which holds the connection body in a state in which a connection of the liquid introduction portion with the liquid outlet portion is released, wherein the connection body is configured to removably connect to the connection body holding portion such that the connection body is held in place when connected to the connection body holding portion.

2. The liquid supply device according to claim 1, wherein the connection body holding portion and the connection body which is held by the connection body holding portion are provided at a position that deviates from a setting path, wherein the liquid container passes through the setting path when the liquid container is set in the liquid container support portion.

3. The liquid supply device according to claim 2, wherein the liquid container support portion includes a mounting surface onto which the liquid container is mounted, and wherein the connection body holding portion and the connection body which is held by the connection body holding portion are provided to be positioned below a plane which includes the mounting surface.

4. The liquid supply device according to claim 3, wherein the mounting surface is inclined such that a back side in a setting direction is lower than a front side in the setting direction with respect to the liquid container support portion of the liquid container.

5. The liquid supply device according to claim 2, wherein the connection body holding portion is provided closer to a front side in a setting direction with respect to the liquid container support portion of the liquid container than the liquid container which is supported by the liquid container support portion.

6. The liquid supply device according to claim 2, wherein the connection body includes a locking-target portion which is locked to a locking portion of the liquid container in a state in which the liquid introduction portion is connected to the liquid outlet portion, and an operation unit which releases a locking state between the locking-target portion and the locking portion, and wherein the connection body holding portion holds the connection body in a posture at which the operation units are closer to a front side in a setting direction with respect to the liquid container support portion of the liquid container than the locking-target portion.

7. The liquid supply device according to claim 2, wherein the connection body includes an electrical connection portion to which the liquid container is connected, and wherein the connection body holding portion holds the connection body in a posture at which the electrical connection portion is closer to a top side than the liquid introduction portion.

8. The liquid supply device according to claim 2, wherein the connection body holding portion includes a cap portion which covers the liquid introduction portion or a space which includes the liquid introduction portion.

* * * * *